United States Patent [19]

Bauver, II

[11] Patent Number: 4,589,353

[45] Date of Patent: May 20, 1986

[54] WOOD BURNING FURNACE

[75] Inventor: Wesley P. Bauver, II, Poquonock, Conn.

[73] Assignee: Combustion Engineering, Inc., Windsor, Conn.

[21] Appl. No.: 696,176

[22] Filed: Jan. 29, 1985

[51] Int. Cl.[4] ..... F23G 5/00; F23G 7/00

[52] U.S. Cl. ..... 110/244; 110/346

[58] Field of Search ..... 110/243, 244, 264, 346, 110/347, 263

[56] References Cited

U.S. PATENT DOCUMENTS

| | | | |
|---|---|---|---|
| 2,483,728 | 10/1949 | Glaeser | 110/244 |
| 3,955,512 | 5/1976 | Martin et al. | 110/244 X |
| 4,159,000 | 6/1979 | Iwasaki et al. | 110/244 |
| 4,308,806 | 1/1982 | Uemura et al. | 110/244 |
| 4,475,472 | 10/1984 | Adrian et al. | 110/264 X |

FOREIGN PATENT DOCUMENTS

| | | | |
|---|---|---|---|
| 2098538 | 2/1972 | France | 110/244 |

*Primary Examiner*—Edward G. Favors

*Attorney, Agent, or Firm*—Robert L. Olson

[57] ABSTRACT

A furnace (10) for burning cellulosic fuel has walls (64) which taper upwardly and outwardly, such that a given level or height (66) the cross-sectional flow area is $1\frac{1}{2}$ to 2 times the cross-sectional flow area near the bottom of the furnace. Thus the gas velocity continuously decreases, as the cross-sectional area increases. Any partially burned char particles initially entrained in the gases near the furnace bottom reach a height in the furnace where the gas velocity equals the particle terminal velocity, so that the particles remains suspended at this height until combustion as reduced their size enough so they can be carried on out of the furnace by the reduced gas velocity.

1 Claim, 1 Drawing Figure

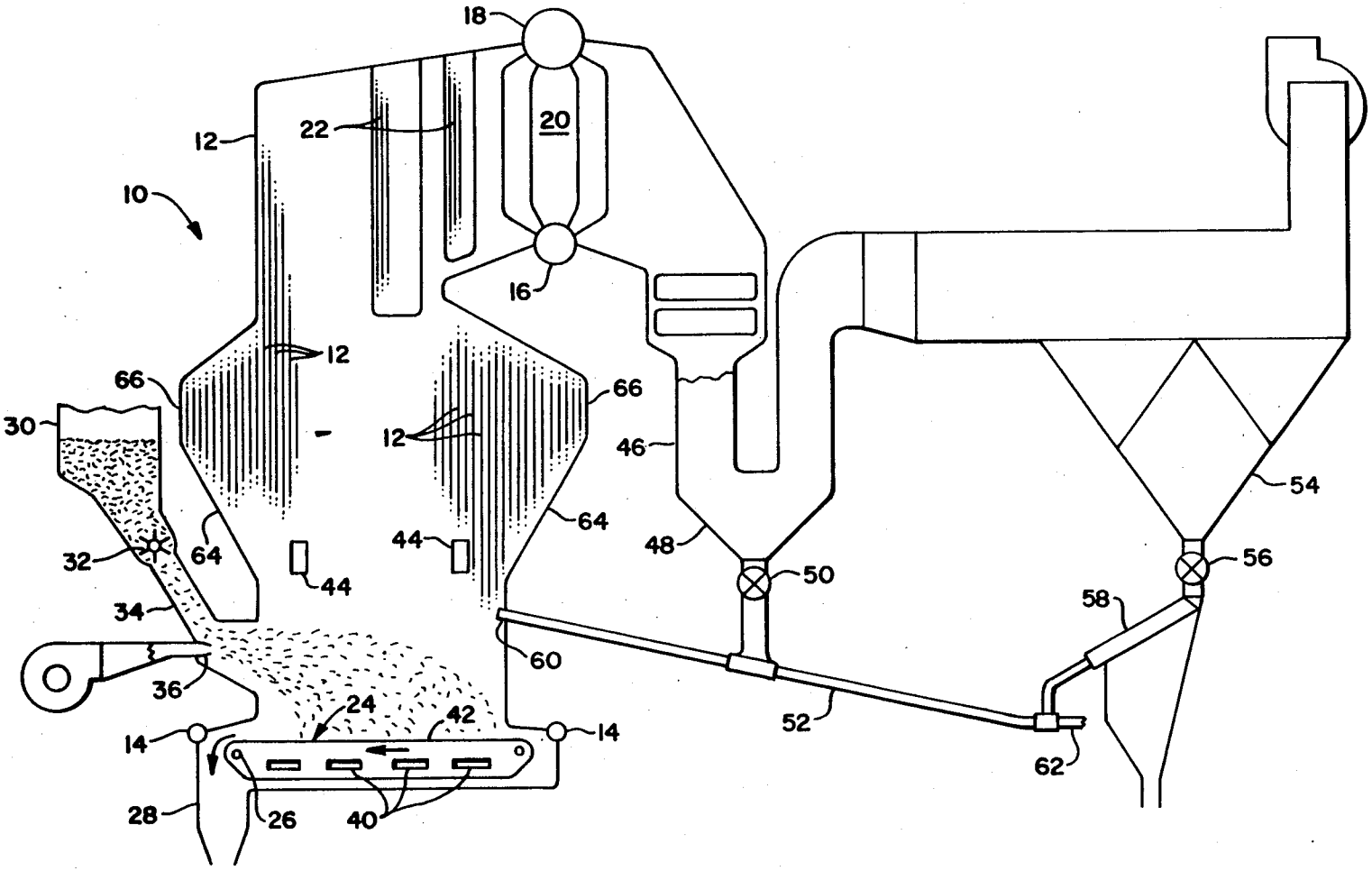
10
12
14
16
18
20
22
24
26
28
30
32
34
36
40
42
44
46
48
50
52
54
56
58
60
62
64
66

WOOD BURNING FURNACE

BACKGROUND OF THE INVENTION

In furnaces in which wood or other cellulose fuel is burned, a common problem is that the high velocity flow of the combustion gases up through the furnace carries a large amount of partially combusted particles along with it. These partially combusted particles or char are separated out of the gases exhausted from the furnace and reinjected into the furnace for complete combustion thereof. This recirculation of char particles reduces the overall plant efficiency and increases capital costs.

SUMMARY OF THE INVENTION

A furnace for burning wood chips or other cellulose fuel is provided which has an increasing cross-sectional area as you move up in height. Thus the gas velocity continuously decreases as the cross-sectional area increases. Any partially burned particles that are initially picked up by the upwardly flowing combustion gases will reach a height where the gas velocity equals the particle terminal velocity. The particles will remain suspended at this level until combustion reduces their size sufficiently so that they can be carried up and out of the furnace by the lower gas velocities.

BRIEF DESCRIPTION OF THE DRAWING

The FIGURE is a sectional side view of a traveling grate furnace incorporating the invention.

DESCRIPTION OF THE PREFERRED EMBODIMENT

Looking now to the drawing, numeral 10 denotes a furnace in which wood chips or other cellulose fuel is burned. The furnace is lined with water-cooled tubes 12 which are supplied by headers 14. The headers receive water from the lower drums 16 through downcomers (not shown). A mixture of steam and water exits from the upper ends of tubes 12 into upper drum 18. Steam is also generated in the boiler section 20 of the unit. The steam passes from drum 18 to superheaters 22, and from there flows to its ultimate point of use.

Looking now to the combustion portion of the furnace, fuel is burned on a traveling grate 24. The grate travels in a counter-clockwise direction by being driven from the forward shaft 26. The speed at which the grate travels will be set so as to obtain as complete combustion of the fuel as possible, depending on the make-up of the fuel and the size of the fuel particles. The ash is discharged from the end of the grate through discharge chute 28.

Wood chips or bark is fed to the furnace from a storage bin 30 through a rotary star valve 32 or other metering device. The chips fall by gravity through duct 34 and are then blown into the furnace by air from a plurality of high pressure air jet nozzles 36 which are equally spaced across the width of the furnace. The air velocity is adjusted such that the wood chips are distributed along the entire length of the traveling grate. Air to support combustion of the fuel is introduced through openings 40 beneath the grate, so as to flow upwardly through openings in the upper grate run 42. Overfire air is supplied to the furnace through ports 44.

The combustion gases leaving the furnace pass through an air heater 46 before being exhausted to the atmosphere. These combustion gases carry some char and ash out of the furnace, with most of the char particles (generally being larger than ash) being separated out of the gas stream as the gases make a turn and flow up out of the air heater. These char particles, which fall into hopper 48, pass into pipe 52 through star valve 50 for reinjection into the furnace. More of the remaining solids are separated out of the gases and fall into a second hopper 54. At this point, a large percentage of the solids are ash, in addition to some char. Thus star valve 56 discharges this mix to an ash-char separator 58 where the ash is separated in any well-known manner, for example by a size separating procedure (the ash particles being finer). The char particles flow through pipe 52 from the two hoppers to a plurality of inlet nozzles 60, which are equally distributed across the width of the unit so as to reinject these char particles into the furnace onto the upper run 42 of the grate. Pressurized air from pipe 62 can be used to move the char particles through pipe 52 into the furnace.

As mentioned earlier, one of the major problems of a wood fired furnace is that the high velocity flow of the combustion gases up through the furnace carries a large amount of partially combusted particles or char along with it. In order to minimize this, the furnace of the present invention is constructed such that it has an increasing cross-sectional area as you move up in height. Thus the gas velocity continuously decreases as the cross-sectional area increases. Any partially unburned particles that are initially entrained by the upwardly flowing gases, will reach a height in the furnace where the gas velocity equals the particle terminal velocity. The particles will remain suspended at this level or height until combustion reduces their size sufficiently so that they can be carried up out of the furnace (usually after complete combustion). In the present furnace, the walls 64 taper upwardly and outwardly from a level above the grate to a level 66, where the cross-sectional area should be on the order of $1\frac{1}{2}$ to 2 times that of the cross-section at the grate level. Thus the flow velocity at level 66 is only half of that at a point in the furnace below where the tapered walls begin (when the area is double). The lift force on a particle is a function of the velocity squared. Thus a particle which can be initially entrained in the high flow velocity will have to be reduced in weight to $\frac{1}{4}$ its original size before it can be carried on out of the furnace. In many instances, complete combustion occurs during this time period.

The increasing cross-section of the furnace can be accomplished in any practical manner; i.e. either two or all four of the walls can be tapered outwardly.

I claim:

1. In combination, a furnace having four walls for burning cellulosic fuel therein, a grate in the furnace bottom on which the fuel is burned, means for introducing cellulosic fuel onto the grate, means for introducing air into the furnace for supporting combustion of the fuel, a rear gas pass connected to the upper end of the furnace, the walls of the furnace being inclined upwardly and outwardly from the grate in such a manner that at a given height above the grate, the cross-sectional flow area is $1\frac{1}{2}$ to 2 times the flow area closely adjacent to the grate, such that most of the partially burned char particles entrained in the gases near the grate reach a height in the furnace where the gas velocity equals the particle terminal velocity, so that most of the particles remain suspended at this height until combustion has reduced their size enough so that they can be carried into the rear pass by the reduced gas velocity.

* * * * *